US008845124B2

(12) United States Patent
Beausoleil et al.

(10) Patent No.: US 8,845,124 B2
(45) Date of Patent: Sep. 30, 2014

(54) SECURITY LIGHTING SYSTEMS FOR PERIMETER FENCES

(76) Inventors: David M. Beausoleil, Ridgewood, NJ (US); Paul Eugene Britt, Los Angeles, CA (US)

( * ) Notice: Subject to any disclaimer, the term of this patent is extended or adjusted under 35 U.S.C. 154(b) by 64 days.

(21) Appl. No.: 13/357,688

(22) Filed: Jan. 25, 2012

(65) Prior Publication Data

US 2013/0188348 A1 Jul. 25, 2013

(51) Int. Cl.

| | |
|---|---|
| ***F21S 8/00*** | (2006.01) |
| ***F21V 1/00*** | (2006.01) |
| ***F21S 4/00*** | (2006.01) |
| ***F21V 21/00*** | (2006.01) |
| ***F21V 7/00*** | (2006.01) |
| ***F21V 11/00*** | (2006.01) |
| ***A47B 96/06*** | (2006.01) |
| ***A47G 29/00*** | (2006.01) |
| ***A47K 1/00*** | (2006.01) |
| ***E04G 3/00*** | (2006.01) |
| ***E04G 5/06*** | (2006.01) |
| ***F21V 35/00*** | (2006.01) |

(52) U.S. Cl.

USPC ..... 362/152; 362/145; 362/146; 362/235; 362/431; 362/249.01; 362/249.02; 362/296.01; 362/396; 362/341; 362/351; 248/219.4

(58) Field of Classification Search

USPC ..... 362/235, 145, 146, 152, 431, 249.01, 362/249.02, 296.01, 217.05, 341, 351, 396; 248/219.4

See application file for complete search history.

(56) References Cited

U.S. PATENT DOCUMENTS

| | | | | |
|---|---|---|---|---|
| 1,806,773 | A * | 5/1931 | Waters | 362/235 |
| 3,222,509 | A * | 12/1965 | Thedford | 362/152 |
| 4,626,974 | A * | 12/1986 | Dean | 362/396 |
| 5,429,340 | A | 7/1995 | Young et al. | |
| 5,718,403 | A * | 2/1998 | Ott et al. | 248/228.1 |
| 5,887,856 | A | 3/1999 | Everly, III | |
| 6,523,982 | B1 * | 2/2003 | Haddad | 362/375 |
| 6,722,637 | B2 | 4/2004 | Burkart et al. | |
| 7,587,860 | B1 | 9/2009 | Ilyas et al. | |
| 7,661,837 | B1 | 2/2010 | Pever et al. | |

(Continued)

FOREIGN PATENT DOCUMENTS

WO WO 2010087697 A1 * 8/2010 ..... F21V 33/00

*Primary Examiner* — Peggy Neils
*Assistant Examiner* — William N Harris
(74) *Attorney, Agent, or Firm* — Doherty IP Law Group LLC

(57) ABSTRACT

A security lighting system includes security lights mounted atop fence posts. Each security light has a light module including a central housing having outwardly extending support arms. A LED unit is mounted in a depression formed in a top surface of the central housing, and a hat covers the top surface of the central housing for allowing only reflected light to escape from light module. The security light has a junction box containing electrical components, and an extension tube having an upper end secured to the light module and a lower end secured to the junction box. The security light includes a clamp assembly for securing the junction box atop a fence post, and an alignment system for aligning the extension tube with the longitudinal axis of the fence post so that the support arms extend perpendicular to the longitudinal axis of the fence post.

23 Claims, 17 Drawing Sheets

(56) References Cited

U.S. PATENT DOCUMENTS

| | | | | |
|---|---|---|---|---|
| 2001/0052595 | A1 | 12/2001 | Hulett | |
| 2002/0148183 | A1 | 10/2002 | Grant | |
| 2003/0066992 | A1 | 4/2003 | Burkart et al. | |
| 2003/0075712 | A1 | 4/2003 | Lin | |
| 2007/0222399 | A1* | 9/2007 | Bondy et al. | 315/291 |
| 2008/0099751 | A1 | 5/2008 | Chen | |
| 2008/0296545 | A1 | 12/2008 | Chef | |
| 2010/0097206 | A1 | 4/2010 | Jung et al. | |
| 2010/0208466 | A1* | 8/2010 | Luo et al. | 362/297 |
| 2010/0327768 | A1* | 12/2010 | Kong et al. | 315/294 |
| 2011/0080749 | A1* | 4/2011 | Roth | 362/414 |
| 2013/0077327 | A1* | 3/2013 | Butler et al. | 362/431 |

* cited by examiner

SECURITY LIGHTING SYSTEMS FOR PERIMETER FENCES

BACKGROUND OF THE INVENTION

1. Field of the Invention

The present application is generally directed to lighting systems, and is more specifically directed to security lighting systems for fences.

2. Description of the Related Art

Lights are often used on or near fences to provide visibility, safety and security. Security lighting is particularly important for perimeter fences that surround secure areas such as automobile lots, military bases, nuclear power plants, industrial sites, college campuses, etc.

Large perimeter fences may extend for hundreds or thousands of feet. The lighting for these fences is typically 120V AC, which requires a lot of energy. Thus, providing security lighting for a perimeter fence can be very expensive. Moreover, the high voltage lighting must be installed by registered electricians, which takes a significant amount of time (e.g., permits and plans), and costs a significant amount of money.

The area covered by a perimeter fence can be so large that remote cameras must be used to effectively monitor the perimeter. Unfortunately, at night, the light generated by the security lighting may create "hot spots" on the camera lens, effectively blinding the camera, whereupon security personnel may not be able to clearly see the perimeter area of the fence.

In view of the above deficiencies, there is a need for a security lighting system that uses less power, which will save money and enable non-electricians to install a security lighting system. There is also a need for a security lighting system that generates indirect, reflected light that will not blind remote cameras are used for monitoring the perimeter of a fence.

SUMMARY OF THE INVENTION

The present invention provides an easy to install, low energy security lighting system for existing and new fences, such as perimeter fences, chain-link fences, panel fences, etc. In one embodiment, a security lighting system for a fence includes a plurality of security lights, each security light having a light module with a LED unit adapted to generate light and a hat overlying the LED unit that is adapted to block the escape of direct light from the light module while allowing reflected light to escape from the light module. The system includes a circuit with electrical wiring interconnecting the plurality of security lights, and a transformer connected with the electrical wiring for providing power to the system. In one embodiment, the transformer produces a direct current output, such as 12-24 VDC. In one embodiment, the transformer produces an alternating current output such as 12-24 VAC.

In one embodiment, each the light module includes a central housing having an upper end with a top surface, support arms extending outwardly from the central housing, a depression formed in the top surface of the central housing, and the LED unit disposed in the depression.

In one embodiment, the support arms extend outwardly from the central housing, and each support arm has a top surface that lies in a plane that is parallel to the top surface of the central housing. In one embodiment, the support arms have a triangular cross-sectional shape that minimizes the likelihood of light reflecting off the arm and back into the underside of the hat In one embodiment, the hat is secured to the support arms. The hat has a bottom surface having a concave shape that overlies the LED unit. The concave shaped bottom surface has a centrally located dimple that is aligned over the LED unit. The centrally located dimple divides the concave shaped bottom surface into a first concave region and a second concave region. The concave bottom surface of the hat preferably has a reflective coating for reflecting light generated by the LED unit.

In one embodiment, the support arms are evenly spaced from one another, and the hat has an outer perimeter in contact with the support arms. In one embodiment, the outer perimeter of the hat lies in a plane that is parallel to the surface of the central housing. In one embodiment, the outer surface of the support arms and the central housing of the light module preferably have reflective coatings for maximizing the amount of light that escapes from the security light.

One or more fasteners may be used for securing the hat to the support arms. In one embodiment, the outer ends of the support arms have openings, and the hat has threaded openings accessible at the outer perimeter thereof that are aligned with the support arm openings. In one embodiment, the threaded fasteners are passed through the support arm openings and threaded into the threaded openings of the hat for securing the hat to the support arms.

In one embodiment, the system includes a junction box having an interior compartment adapted to contain electrical components for operating the security light, and an extension tube having an upper end secured to the central housing of the light module and a lower end secured to the junction box.

In one embodiment, the system preferably includes a clamp assembly coupled with the junction box for securing the junction box atop or against a fence post. The system preferably has an alignment system coupled with the junction box for aligning the extension tube with the longitudinal axis of the fence post and aligning the support arms with a plane that is perpendicular to the longitudinal axis of the fence post.

In one embodiment, a security lighting system for a fence has a plurality of security lights mountable to upper ends of fence posts. Each security light may have a light module including a central housing having a top surface, a depression formed in the top surface of the central housing, and a LED unit mounted in the depression for generating light that projects away from and over the top surface of the central housing. A hat preferably covers the top surface and an outer perimeter of the central housing for blocking the escape of direct light from the top and sides of the light module while allowing reflected light to escape from a bottom of the light module. The hat desirably has a concave shaped bottom surface with a reflective coating that opposes the LED unit for reflecting light generated by the LED unit toward the bottom of the light module. The hat is preferably opaque so that no light can pass through the body of the hat.

In one embodiment, a security light preferably has a junction box having an interior compartment adapted to contain electrical components for operating the security light, and an extension tube having an upper end secured to the central housing of the light module and a lower end secured to the junction box. The extension tube has a central conduit for passing electrical wiring from the junction box to the light module. A clamp assembly is preferably coupled with the junction box for securing the junction box to a fence post on a new or existing fence. An alignment system, separate from the clamp assembly and coupled with the junction box, is adapted for aligning the extension tube with the longitudinal axis of the fence post and aligning the support arms with a plane that is perpendicular to the longitudinal axis of the fence post.

In one embodiment, a security lighting system for a fence preferably includes one or more motion sensors that are adapted to activate the lighting system or one or more of the security lights, as designated by an installer.

In one embodiment, a security lighting system for a fence preferably includes one or more remote cameras for monitoring the fence. The lighting system may include a video recording system for recording and storing video.

In one embodiment, the system desirably includes electrical wiring interconnecting the plurality of security lights, and a transformer connected with the electrical wiring for providing power to the plurality of security lights. The transformer desirably produces a direct current output of 12-24 VDC. In one embodiment, the transformer may produce an alternating current of 12-24 VAC.

These and other preferred embodiments of the present invention will be described in more detail below.

DETAILED DESCRIPTION

Figure 1:
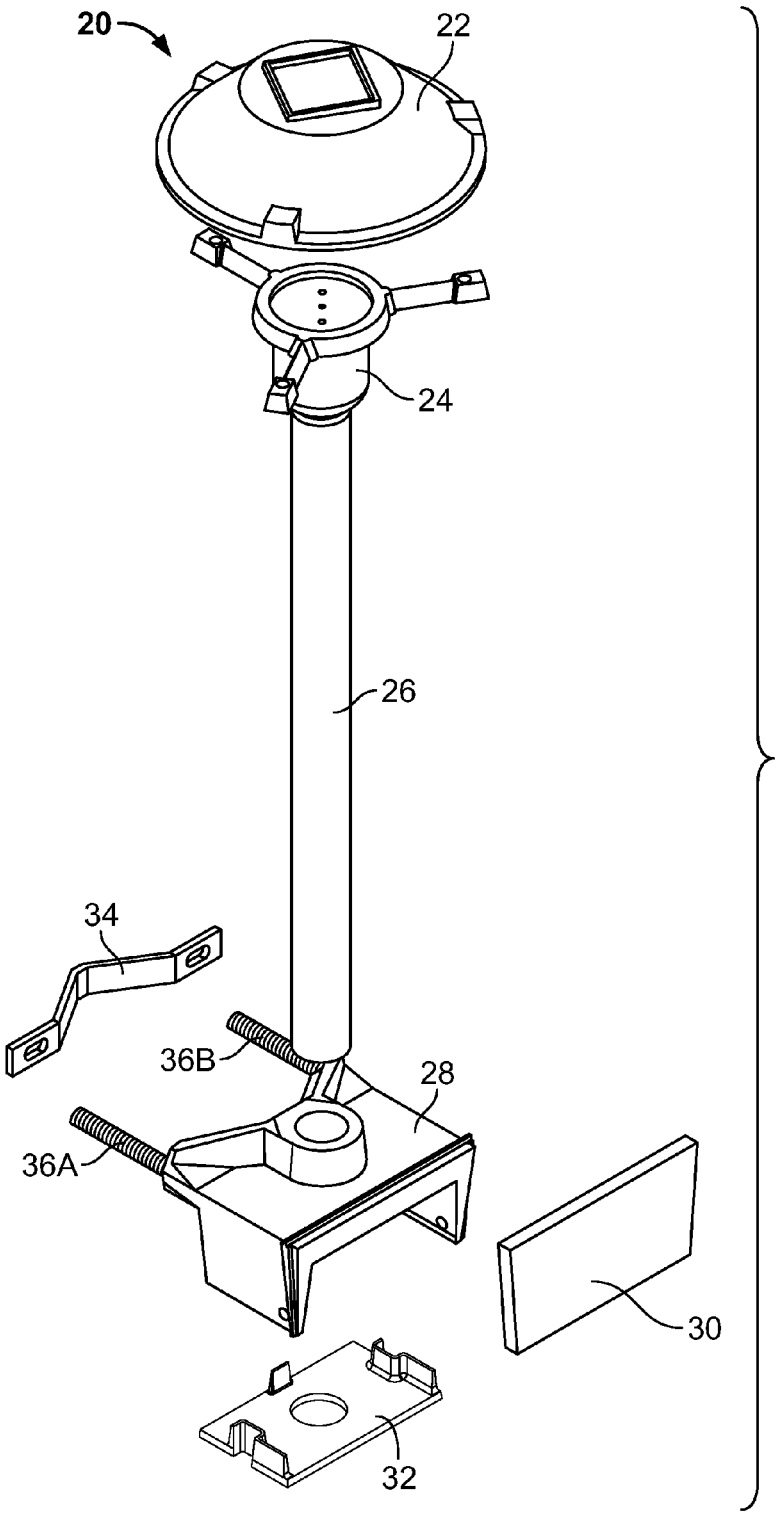
FIG. 1 is an exploded view of a security light for a perimeter fence including a hat, a light module, an extension tube, a junction box, a front cover plate, a bottom cover plate, and a securing bracket, in accordance with one embodiment of the present invention.

Referring to FIG. 1, in one embodiment, a security light 20 includes a hat 22, a light module 24, an extension tube 26, a junction box 28, a front cover plate 30, a bottom cover plate 32, a securing bracket 34, and threaded bolts 36A, 36B that project from a rear end of the junction box.

Figure 2A:
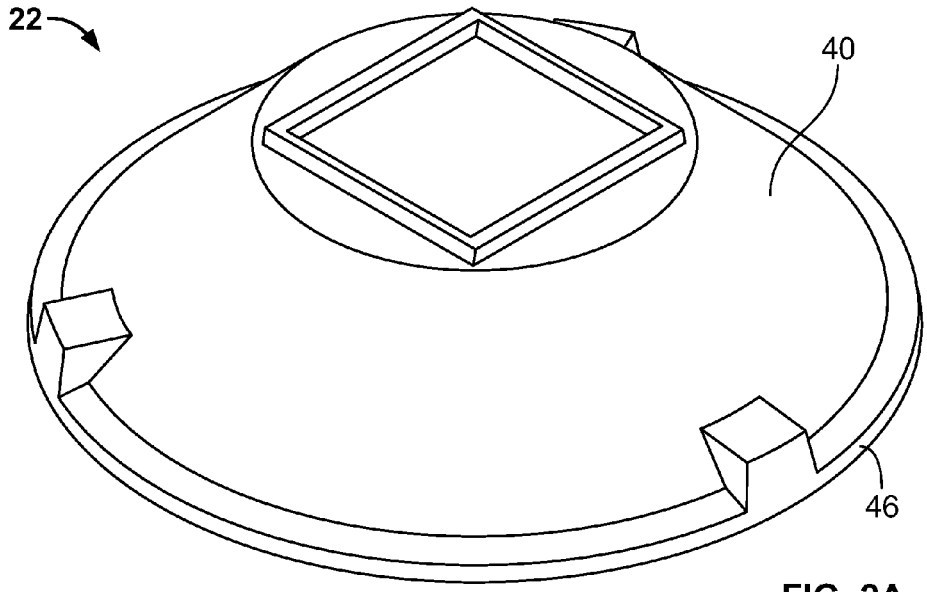
FIG. 2A is a top perspective view of the hat shown in FIG. 1, in accordance with one embodiment of the present invention.
Figure 2B:
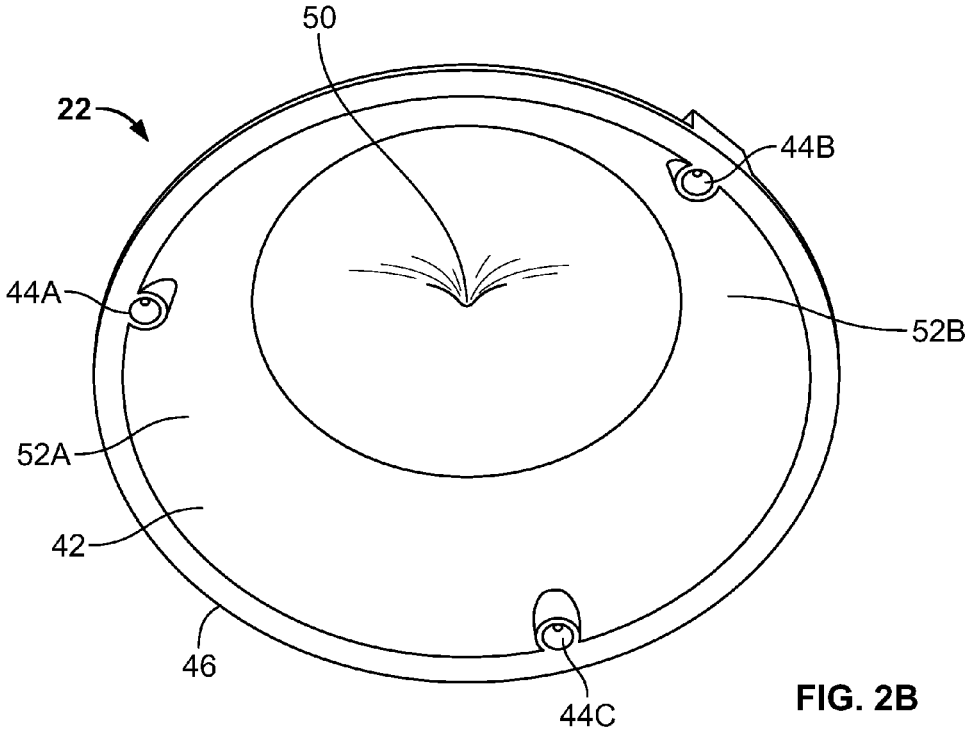
FIG. 2B is a bottom perspective view of the hat shown in FIG. 2A.

Referring to FIGS. 2A and 2B, in one embodiment, the security light includes the hat 22 having a top surface 40 and a bottom surface 42. In one embodiment, the top surface 40 is convex and the bottom surface 42 has a double concave surface. Referring to FIG. 2B, in one embodiment, the hat 22 includes threaded openings 44A-44C that are adapted to receive threaded fasteners for securing the hat over the light module 24 (FIG. 1), as will be described in more detail herein. The threaded openings 44A-44C are preferably evenly spaced from one another around the outer perimeter 46 of the hat 22. In one embodiment, the hat has three threaded openings 44A-44C. In other embodiments, however, the hat 22 may have fewer or more threaded openings that are evenly spaced from one another around the outer perimeter 46 of the hat 22.

In one embodiment, the bottom surface 42 of the hat 22 desirably has a central dimple 50 that divides the bottom surface 42 into a double concavity including a first concave region 52A and a second concave region 52B. The bottom surface 42 may be covered by a reflective coating that reflects light that strikes the bottom surface 42.

Figure 2C:
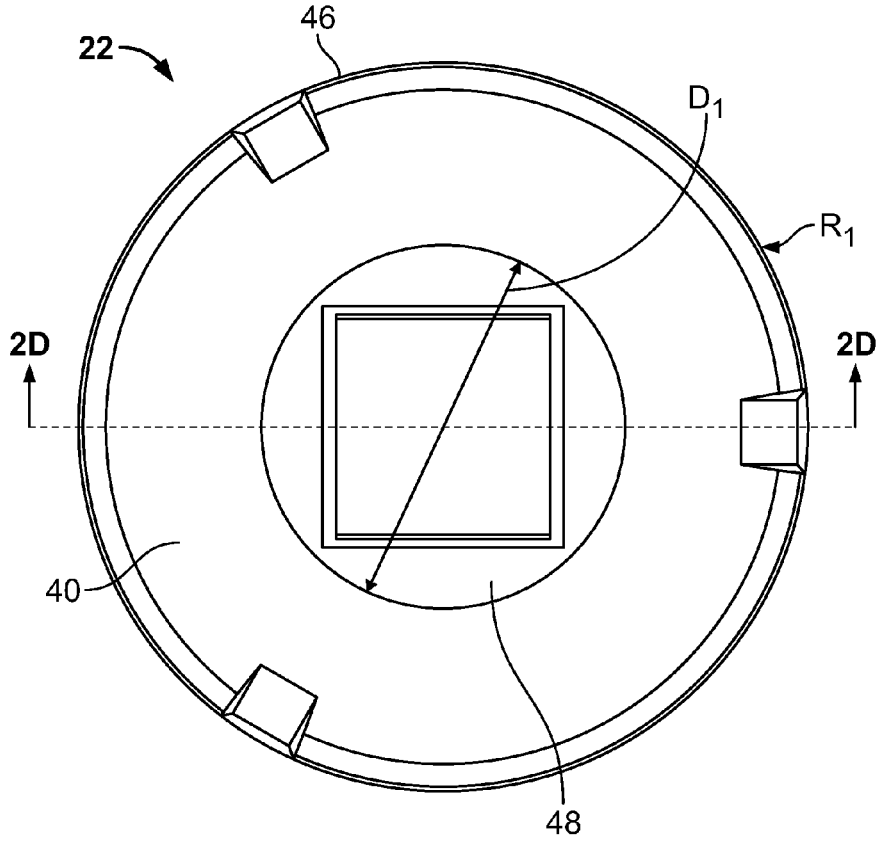
FIG. 2C is a top plan view of the hat shown in FIG. 2A.

Referring to FIG. 2C, in one embodiment, the hat 22 includes the outer perimeter 46 that is preferably circular in shape. The top surface 40 of the hat 22 desirably has a central region 48 adapted for receiving a label, such as a product name or a manufacturer's name. In one embodiment, the central region 48 has a diameter $D_1$ of about 2-3 inches, and more preferably about 2.5 inches. In one embodiment, the outer perimeter 46 of the hat 22 defines a radius $R_1$ of about 2-3 inches, and more preferably about 2.5 inches.

Figure 2D:
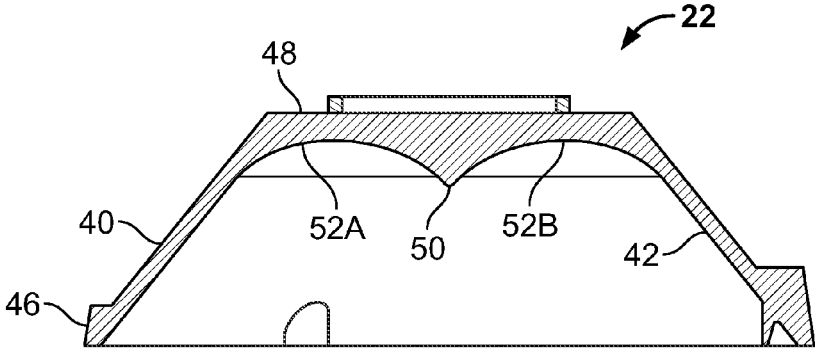
FIG. 2D is a cross-sectional view of the hat shown in FIG. 2C taken along line 2D-2D of FIG. 2C.

Referring to FIG. 2D, in one embodiment, the hat 22 includes the convex top surface 40 and the central region 48. The hat 22 also includes the bottom surface 42 having the double concavity. The centrally located dimple 50 divides the bottom surface 42 into the first concave region 52A and the second concave region 52B. Referring to FIGS. 2B and 2D, the centrally located dimple 50 is desirably centrally located within the concave bottom surface 42. In one embodiment, the central dimple 50 is preferably evenly spaced from the threaded openings 44A-44C provided at the perimeter 46 of the hat 22. In one embodiment, the dimple 50 and the double concave surface 42 preferably reflect light that strikes the bottom surface on an outer direction toward the outer perimeter 46 of the hat 22.

Figure 3A:
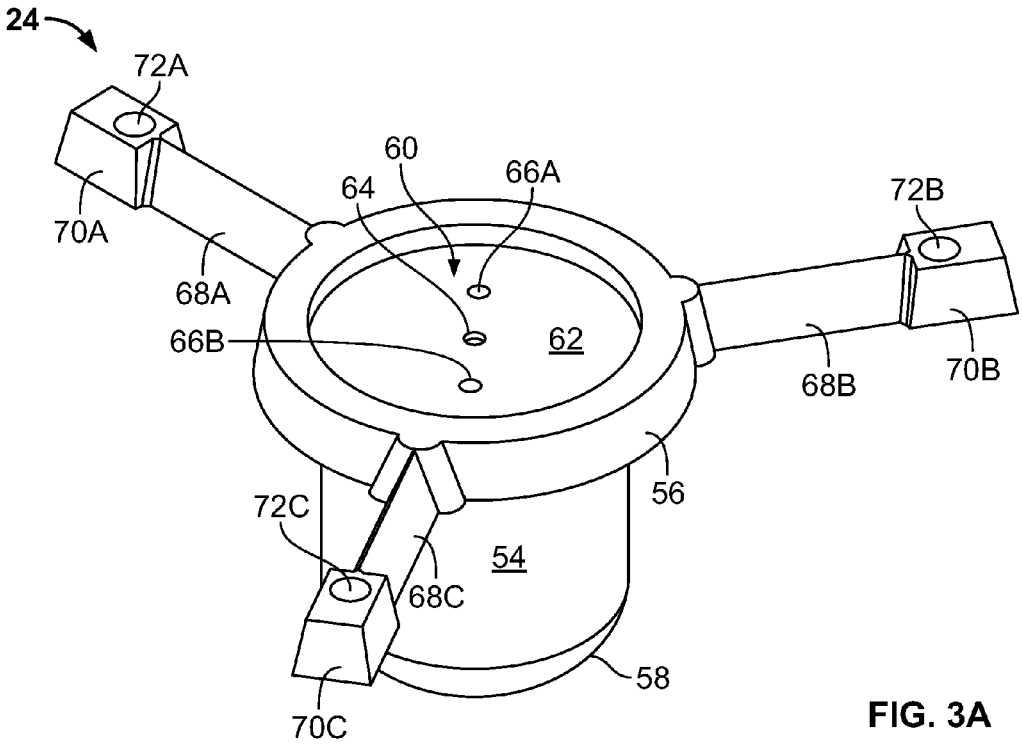
FIG. 3A is a top perspective view of the light module shown in FIG. 1, in accordance with one embodiment of the present invention.

Referring to FIG. 3A, in one embodiment, a security light includes a light module 24 having a central housing 54 with an upper end 56 and a lower end 58. The central housing 54 has a central depression 60 formed in the upper end 56. In one embodiment, the central depression 60 has a circular shape. The central depression 60 includes a floor 62 having a first opening 64 for passing electrical wiring therethrough and a pair of second openings 66A, 66B adapted for securing a light emitting diode module (not shown) over the floor 62 of the central depression 60.

The light module 24 also preferably includes support arms 68A, 68B, 68C that extend outwardly from the central housing 54. The outer ends of the arms 68A-6C preferably have mounting bases 70A-70C adapted to seat an underside of the hat 22 shown and described above in FIGS. 2A-2D. Each of the mounting bases 70A-70C desirably has a opening 72A-72C extending therethrough. The openings 72A-72C are preferably adapted to receive threaded fasteners used for securing the hat (FIG. 2A) over the light module 24. In one embodiment, the openings 72A-72C may have internal threads.

Figure 3B:
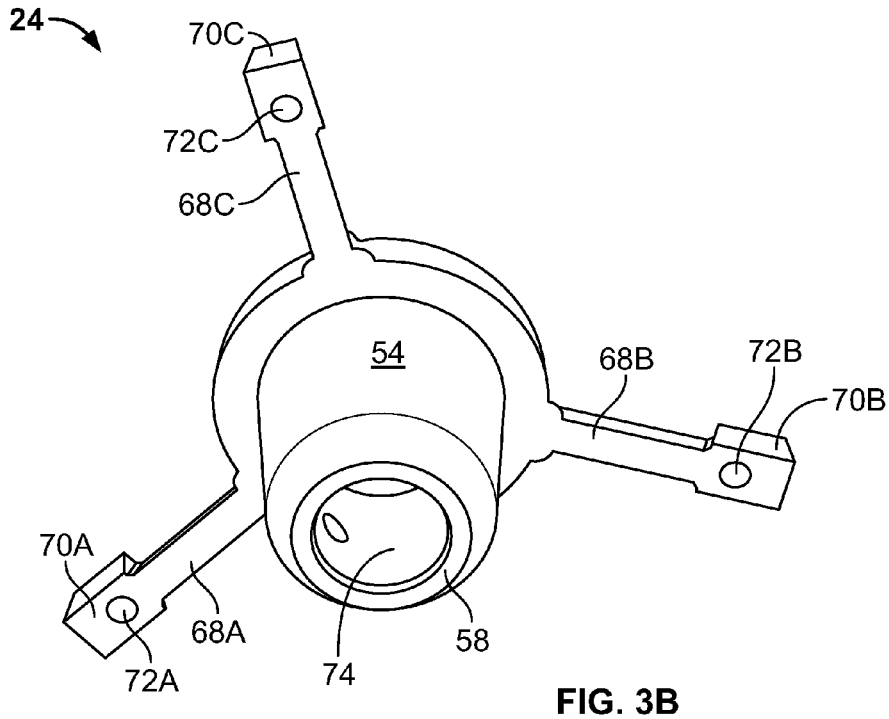
FIG. 3B is a bottom perspective view of the light module shown in FIG. 3A.

Referring to FIG. 3B, the openings 72A-72C extend completely through the respective mounting bases 70A-70C for being accessible at the underside of the arms 68A-68C. The lower end 58 of the central housing 54 preferably includes a central opening 74 adapted to receive an upper end of the extension tube 26 (FIG. 1), as will be described in more detail herein.

Referring to FIGS. 2B and 3B, in one embodiment, the hat 22 is secured to the light module 24 by aligning the threaded openings 44A-44C at the underside of the hat 22 with the respective openings 72A-72C at the ends of the support arms 68A-68C. The threaded fasteners (not shown) may be passed through the openings 72A-72C on the support arms 68A-68C and threaded into the threaded openings 44A-44C accessible at the underside of the hat 22.

Figure 3C:
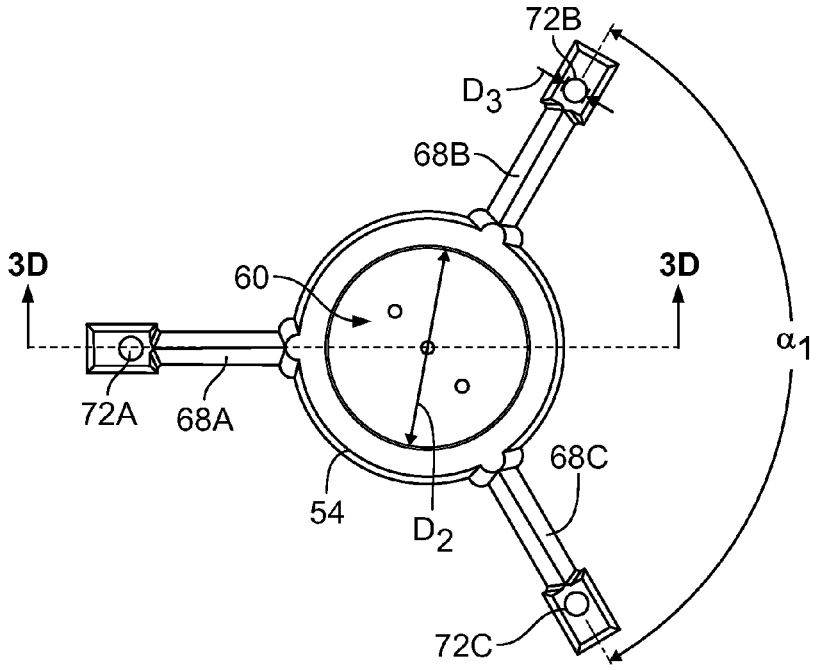
FIG. 3C is a top plan view of the light module shown in FIG. 3A.

Referring to FIG. 3C, in one embodiment, the support arms 68A-68C of the light module are evenly spaced from one another about the perimeter of the central housing 54. In one embodiment, adjacent support arms (e.g., 68B, 68C) define an angle $\alpha_1$ of about 120°. In an embodiment having four support arms, the angle between the adjacent support arms is preferably about 90°. The particular angle between adjacent support arms depends upon the number of support arms projecting outwardly from the central housing 54, with each support arm preferably being evenly spaced around the perimeter of the central housing 54.

In one embodiment, the central depression 60 formed in the upper end of the central housing 54 has a diameter $D_2$ of about 1-2 inches, and more preferably about 1.554 inches. The openings 72A-72C at the outer ends of the support arms 68A-68C preferably have a diameter $D_3$ of about 0.100-0.200, inches and more preferably about 0.188 inches.

Figure 3D:
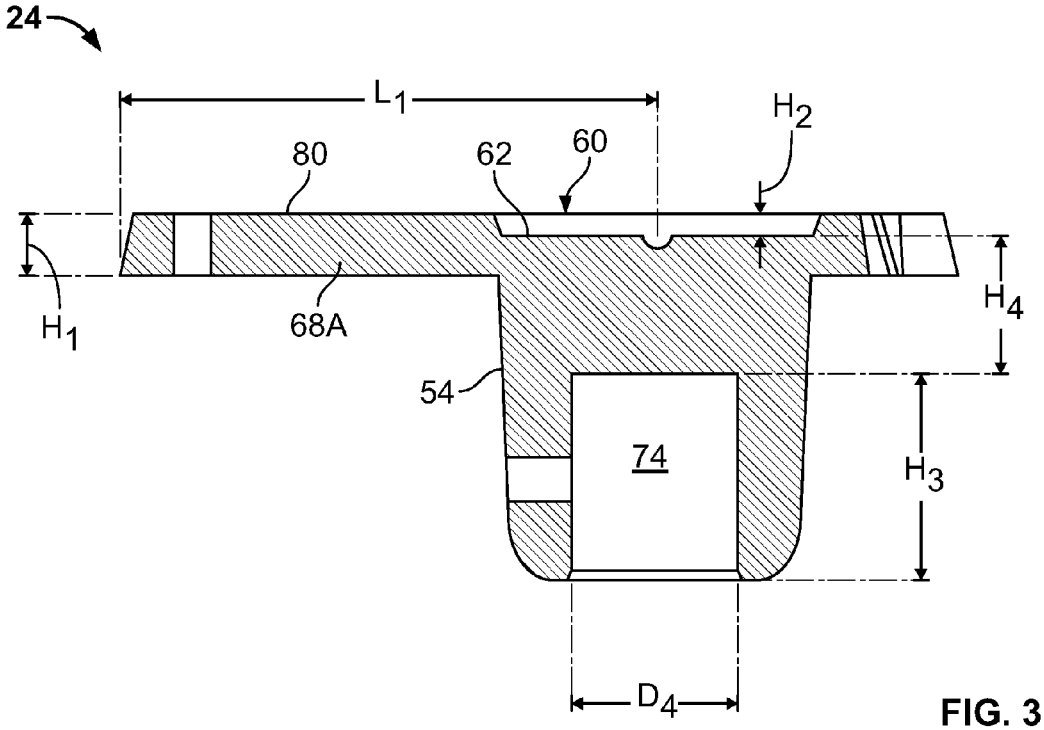
FIG. 3D is a cross-sectional view of the light module shown in FIG. 3C taken along line 3D-3D of FIG. 3C.

Referring to FIG. 3D, in one embodiment, the distance $L_1$ between a center of the central depression 60 and the outer end of the support arm 68A is about 2-3, inches and more preferably about 2.572 inches. The support arm 68A has a height $H_1$ of about 0.200-0.400 inches, and more preferably about 0.300 inches. The central depression 60 preferably includes the floor 62, which is sunken relative to a top surface 80 of the central housing 54. The distance between the floor 62 of the central depression 60 and the top surface 80 of the central housing 54 is designated $H_2$ and is about 0.050-0.150 inches, and more preferably about 0.100 inches.

The light module 24 also preferably includes the central opening 74 formed in the lower end 58 of the central housing 54. The central opening is adapted to receive an upper end of the extension tube 26 (FIG. 1). The central opening 74 preferably has a diameter $D_4$ of about 0.750-0.900 inches, and more preferably about 0.820 inches. The central opening 74 desirably has a height $H_3$ of about 0.750-1.250 inches, and more preferably about 1.000 inches. In one embodiment, the distance $H_4$ between the upper end of the central opening 74 and the floor 62 of the central depression 60 is about 0.500-0.750 inches, and more preferably about 0.667 inches.

Figure 4A:
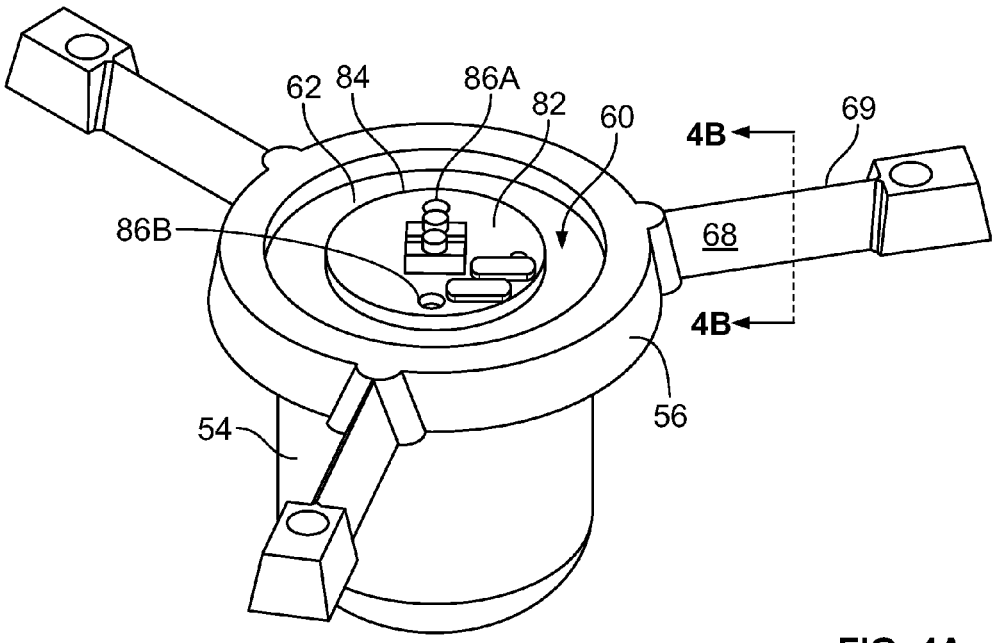
FIG. 4A is a top perspective view of the light module of FIG. 3A with a light emitting diode module secured atop the light module, in accordance with one embodiment of the present invention.

Referring to FIG. 4A, in one embodiment, a light emitting diode (LED) module 82 is secured to the floor 62 of the central depression 60 formed at the upper end 56 of the central housing 54. The LED module 82 preferably includes a circuit board 84 having a pair of openings 86A, 86B extending therethrough. In one embodiment, the LED module 82 is secured to the floor 62 of the central depression 60 by aligning the openings 86A, 86B formed in the LED circuit board 84 with the openings 66A, 66B in the floor 62 of the central depression 60 (FIG. 3A).

Figure 4B:
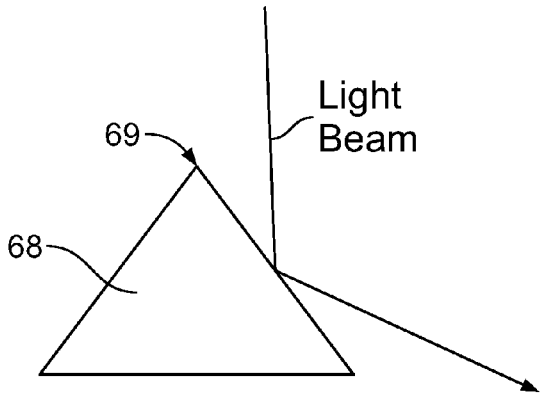
FIG. 4B is a cross-sectional view of a support arm of the light module of FIG. 4A taken along line 4B-4B of FIG. 4A.

Referring to FIGS. 4A and 4B, in one embodiment, the support arms 68 have a triangular shaped cross-section with an apex 69 that extends along the length of the support arm 68. The apex 69 of the support arm 68 defines an upper edge of the support arm that faces toward an underside of the hat for minimizing the surface area of the support arm that is capable of blocking light reflected downwardly by the underside of the hat. The support arm 68 desirably has a reflective coating for reflecting light that strikes the support arm 68.

Figure 5A:
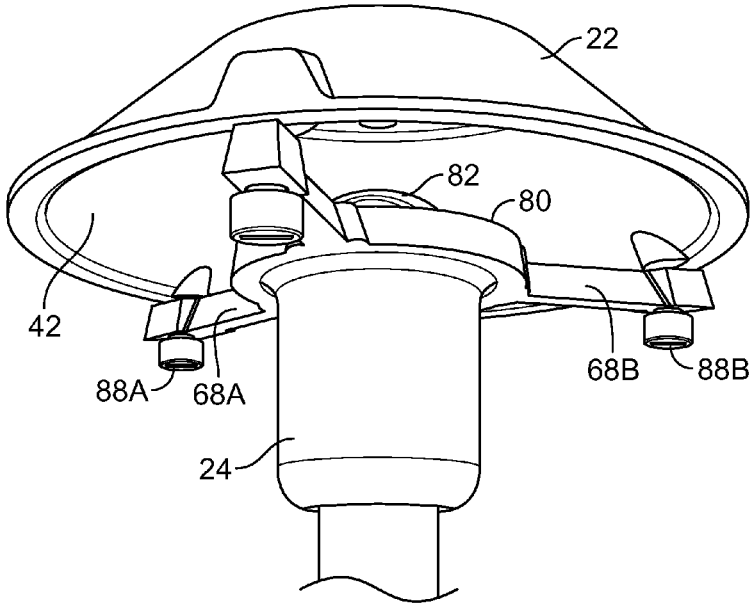
FIG. 5A is a bottom perspective view of the light module of FIG. 4A with the hat of FIGS. 2A-2D secured to support arms of the light module, in accordance with one embodiment of the present invention.
Figure 5B:
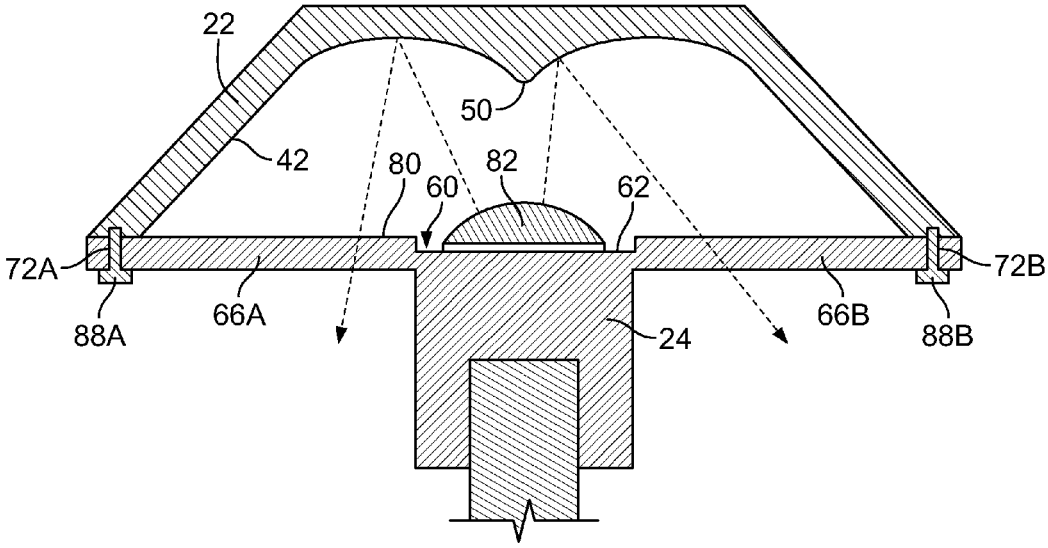
FIG. 5B is a cross-sectional view of the hat, the light module, and the light emitting diode module of FIG. 5A.

Referring to FIGS. 5A and 5B, in one embodiment, the hat 22 (FIGS. 2A-2D) is secured atop the light module 24. The double concave bottom surface 42 of the hat 22 preferably opposes the top surface 80 of the light module 24 and the LED module 82 secured to the floor 62 of the central depression 60. Threaded fasteners 88A-88C are preferably passed through the openings 72 formed in the respective support arms 68A-68C and threaded into the threaded openings provided in the underside of the hat 22 for securing the hat 22 to the support arms 68A-68C of the light module 24.

In one embodiment, after the hat 22 has been secured to the light module 24, the centrally located dimple 50 is desirably centered over the LED module 82. The double concave surface 42 desirably has a reflective coating that reflects the light generated by the LED module. In one embodiment, the light generated by the LED module 82 is reflected by the reflective coating on the double concave surface 42 and re-directed outwardly, in a downward direction. As a result, most, if not all of the light emanating from the security light disclosed herein is reflective light that is directed toward the ground. Thus, security cameras monitoring the security lights atop a perimeter fence will not encounter "hot spots" whereby direct light strikes the lens of a security camera, which may "blind" the security camera due to the intensity of the light. Reflecting the light toward the ground and minimizing direct light emanating from the security light greatly minimizes and/or eliminates "hot spots" to provide for better security monitoring when using security cameras.

Figure 6A:
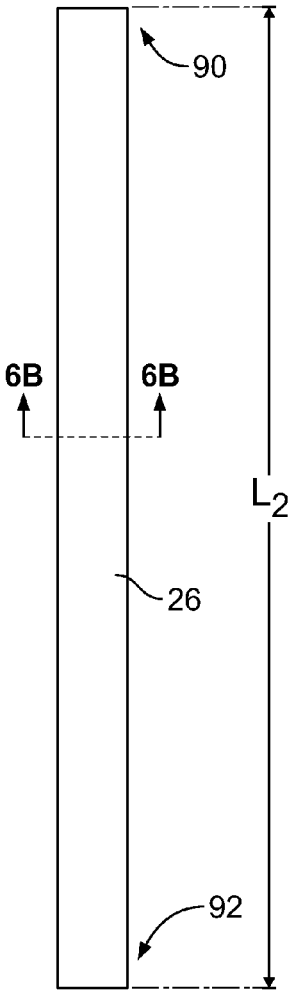
FIG. 6A is a front elevation view of the extension tube shown in FIG. 1, in accordance with one embodiment of the present invention.

Referring to FIG. 6A, in one embodiment, the security light includes an extension tube 26 having an upper end 90 adapted to be inserted into the central opening 74 at the lower end 58 of the central housing 54 of the light module 24 (FIG. 3B). The extension tube 26 also desirably includes a lower end 92 that is adapted to be assembled with the junction box 28 (FIG. 1), as will be described in more detail herein. In one embodiment, the extension tube 26 preferably has a length $L_2$ of about 6-24 inches, and more preferably about 12 inches.

Figure 6B:
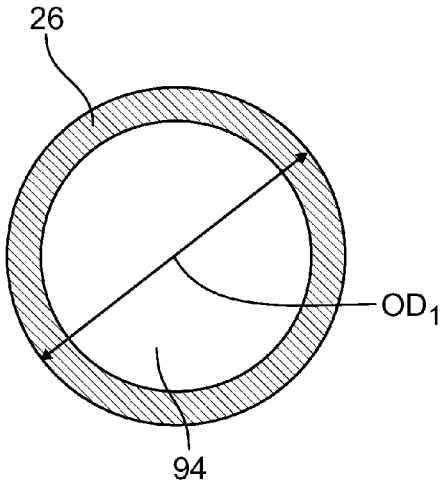
FIG. 6B is a cross-sectional view of the extension tube shown in FIG. 6A taken along line 6B-6B of FIG. 6A.

Referring to FIGS. 6A and 6B, in one embodiment, the extension tube 26 has an outer diameter $OD_1$ of about 0.800-0.900 inches, and more preferably about 0.858 inches. The extension tube 26 preferably has a central, elongated conduit 94 that extends from the upper end 90 to the lower end 92 thereof. The central, elongated conduit 94 is preferably adapted to receive electrical wiring for providing power to the LED module 82 mounted on the light module 24 (FIG. 5). In one embodiment, the extension tube 26 is preferably made of metal such as galvanized steel. In one embodiment, the upper end 90 of the extension tube 26 may have threads and the central opening 74 at the lower end 58 of the central housing 54 (FIG. 3B) may have opposing threads for securing the upper end of the extension tube with the light module. In one embodiment, the lower end 92 of the extension tube 26 may have threads for securing the lower end of the extension tube 26 to the junction box 28 (FIG. 1).

Figure 7A:
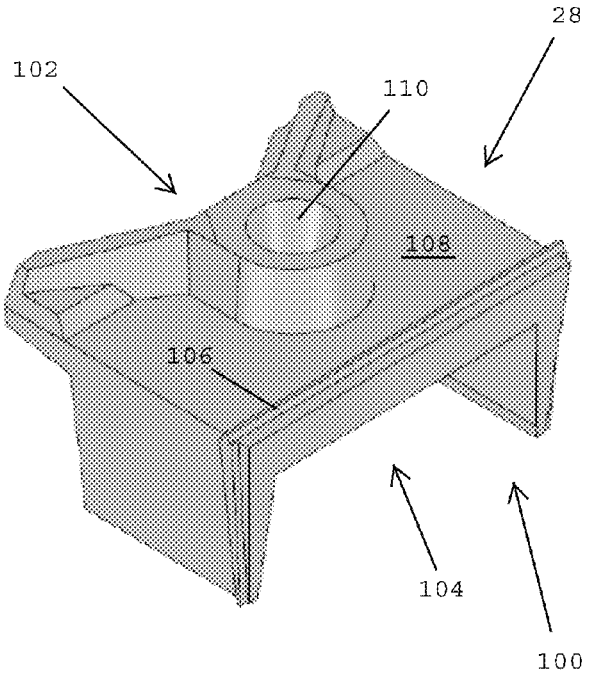
FIG. 7A is a top perspective view of the junction box shown in FIG. 1, in accordance with one embodiment of the present invention.

Referring to FIG. 7A, in one embodiment, a security light preferably includes a junction box 28 that is adapted to contain electrical components such as electrical wiring, circuit boards, and controllers used for providing electrical power to, and operating, the LED module. The junction box 28 preferably includes a front end 100 and a rear end 102. The front end 100 desirably includes a front opening 104 that provides access to an interior region of the junction box 28 for conducting electrical wiring operations. The front end 100 includes a ridge 106 that extends along an upper edge and two side edges of the front opening 104. The ridge 106 is preferably adapted to direct moisture, water and/or rain away from the front opening 104 for minimizing the likelihood that moisture, water and/or rain will enter the interior region of the junction box, which could damage the electrical components contained within the junction box 28.

The junction box 28 preferably includes a top wall 108 having a central opening 110 extending therethrough. The central opening 110 preferably extends through the top wall 108 for providing access to the interior region of the junction box 28.

Figure 7B:
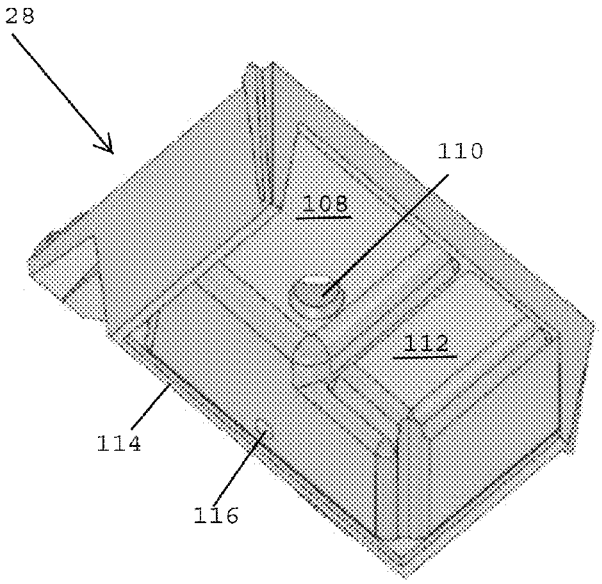
FIG. 7B is a bottom perspective view of the junction box shown in FIG. 7A.

FIG. 7B shows the central opening 110 extending through the top wall 108 and into the interior region of the junction box 28. The central opening 110 is adapted to receive the lower end 92 of the extension tube 26 (FIG. 6A). The central opening 110 may have internal threads adapted to engage opposing threads provided at the lower end of the extension tube for securing the lower end of the extension tube to the junction box 28. In one embodiment, the electrical components contained within the junction box 28 may be electrically interconnected with the LED module 82 (FIG. 4A) by passing electrical wiring through the central opening 110, the elongated conduit 94 of the extension tube 26 (FIG. 6B), through the central opening 64 provided at the lower end 58 of the central housing 54 of the light module 24 (FIG. 3B), and through the opening 64 in the floor 62 of the depression 60 at the upper end 56 of the central housing 54 (FIG. 3A).

Referring to FIG. 7B, in one embodiment, the junction box 28 desirably includes a heat sink 112 provided at an underside of the top wall 108. The heat sink 112 is preferably adapted to receive a circuit board or microprocessor used for controlling the LED module 82 (FIG. 4A) of the security light.

In one embodiment, the junction box 28 includes a vertically extending rear wall 114 that closes the rear end of the internal region of the junction box. The rear wall 114 preferably includes a threaded opening 116 extending therethrough that may be used for receiving a threaded shaft used for aligning the security light atop a vertical post of a fence. As will be described in more detail herein, a threaded alignment shaft may be passed through the threaded opening 116 for adjusting the angle and/or orientation of the junction box 28 relative to a vertical post upon which the security light is mounted. The alignment may be made when the security light is initially mounted atop the perimeter fence. The alignment may also be made after a period of time has passed from the initial mounting of the security light atop a perimeter fence.

Figure 7C:
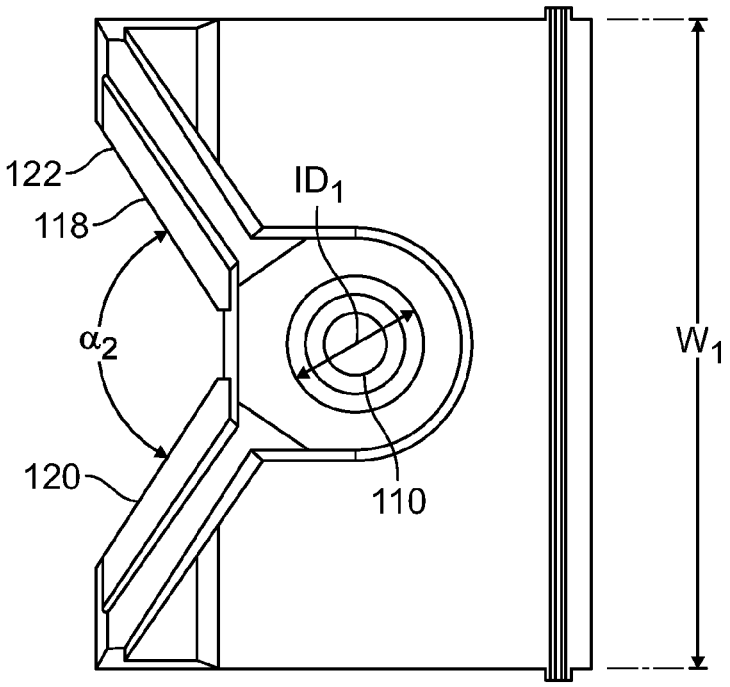
FIG. 7C is a top plan view of the junction box shown in FIG. 7A.

Referring to FIG. 7C, in one embodiment, the rear end 104 of the junction box 28 preferably includes a V-shaped securing flange 118 adapted to abut against an outer surface of a vertically extending post of a fence for securing the junction box atop or against the vertical post. The V-shaped securing flange 118 preferably has a first wing 120 and a second wing 122 that defines an angle $\alpha_2$ of about 100-120° and, more preferably 114.3°.

The junction box 28 preferably has a width $W_1$ of about 3.5-4.0 inches, and more preferably about 3.806 inches. The central opening 110 desirably has an inner diameter $ID_1$ of about 0.700-0.900 inches, and more preferably about 0.800 inches. The inner diameter $ID_1$ of the central opening 110 is preferably adapted to match the outer diameter $OD_1$ of the extension tube 26 (FIG. 6B).

Figure 7D:
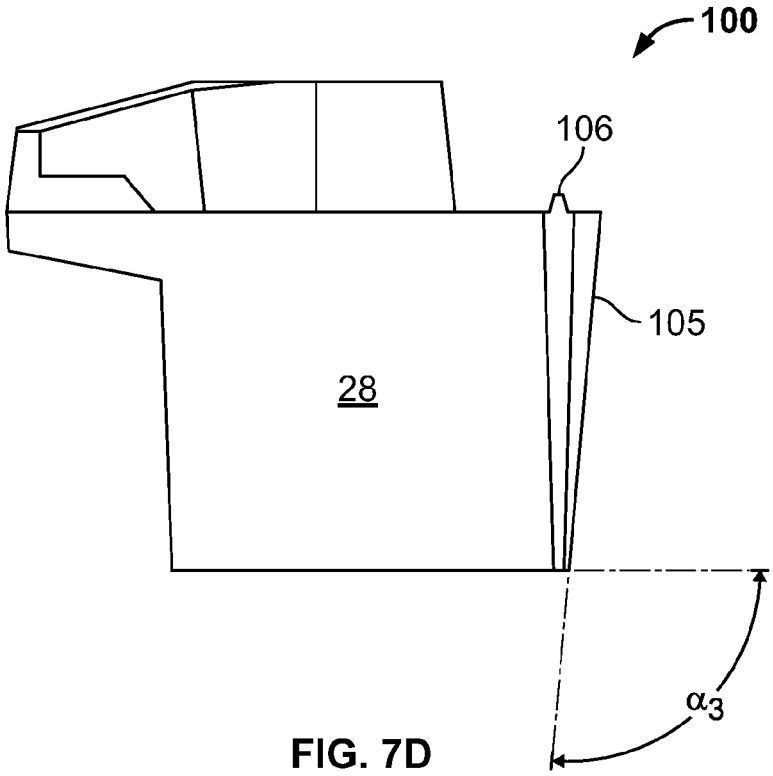
FIG. 7D is a left side view of the junction box shown in FIG. 7A.

Referring to FIG. 7D, in one embodiment, the front end 100 of the junction box 28 desirably includes the ridge 106 that extends around the upper edge and side edges of the front opening 104 (FIG. 7A). As described above, the ridge 106 is preferably adapted for preventing moisture, rain, and/or water from entering the internal region of the junction box 28 through the front opening 104 (FIG. 7A). A front face 105 at the front end 100 of the junction box 28 preferably forms an angle $\alpha_3$ with a bottom edge 120 of the junction box 28 of about 92-98° and more preferably about 95°. The angled front face 105 works in conjunction with the ridge 106 to prevent moisture, water and/or rain from entering the internal region of the junction box 28.

Figure 8A:
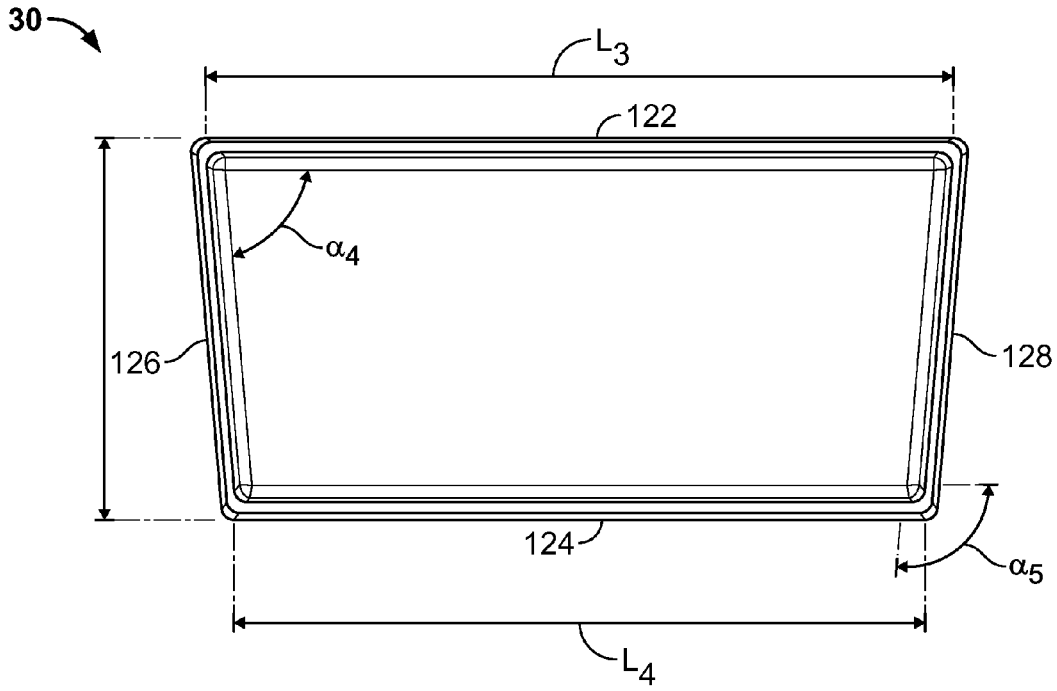
FIG. 8A is a front elevation view of the front cover plate shown in FIG. 1, in accordance with one embodiment of the present invention.

Referring to FIG. 8A, in one embodiment, the security light preferably includes a front cover plate 30 that is adapted to be assembled with the junction box 28 for covering the front opening 104 at the front end 100 of the junction box 28 (FIG. 7A). The front cover plate 30 desirably has an upper edge 122 having a length $L_3$ of about 4-5 inches, and more preferably about 4.201 inches, a lower edge 124 having a length $L_4$ of about 3.5-4 inches, and more preferably about 3.790 inches, and first and second side edges 126, 128 each having a length $L_5$ of about 2.0-2.25 inches, and more preferably about 2.129 inches. The side edges 126, 128 extend inwardly between the upper edge 122 and the lower edge 124. The inward slope preferably defines an angle $\alpha_4$ of less than 90°, and more preferably about 85°. The front face of the front cover plate 30 defines an angle $\alpha_5$ that matches the angle $\alpha_3$ of the front face 100 of the junction box 28 (FIG. 7D), which is about 92-98°, and more preferably about 95°.

Figure 8B:
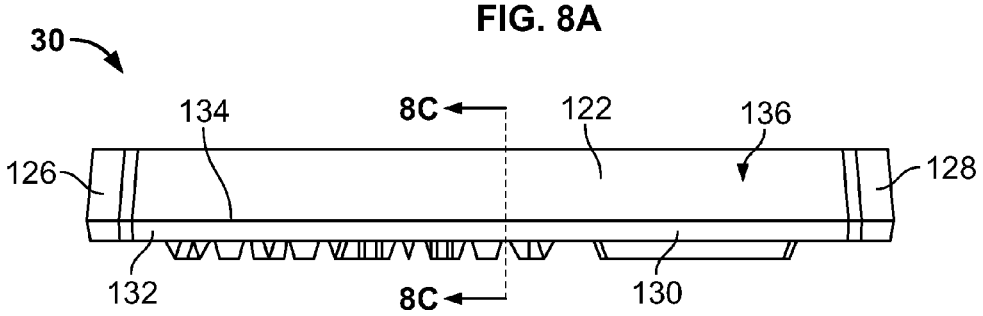
FIG. 8B is a top plan view of the front cover plate shown in FIG. 8A.

Referring to FIG. 8B, the front cover plate 30 includes the front wall 130 having an outer surface 132 and an inner surface 134. The front cover plate 30 also desirably includes side edges 126 and 128 that extend downwardly from the upper edge 122 (FIG. 8A). The front wall 130, the upper edge 122, the lower edge 124 and the side edges 126, 128 define a pocket 136 adapted to cover the front opening 104 of the junction box 28 (FIG. 7A). In one embodiment, the pocket 136 is adapted to receive the ridge 106 extending around the perimeter of the front opening 104 of the junction box 28 (FIG. 7A).

Figure 8C:
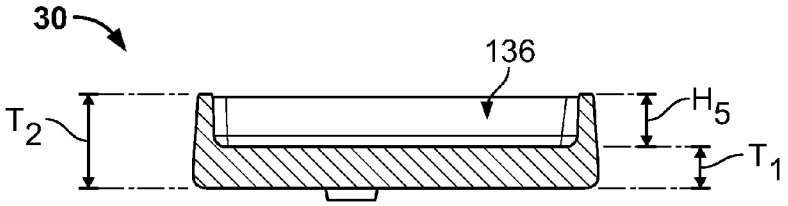
FIG. 8C is a cross-sectional view of the front cover plate of FIG. 8B taken along line 8C-8C of FIG. 8B.

Referring to FIG. 8C, the pocket 136 of the front cover plate 30 has a depth $H_5$ of about 0.250-0.300 inches, and more preferably about 0.275 inches. The front wall 130 has a thickness $T_1$ of about 0.175-0.225 inches, and more preferably about 0.200 inches. The distance T2 between the front face 132 and the rear edge of the side edges 126, 128 is about 0.475 inches.

Figure 9A:
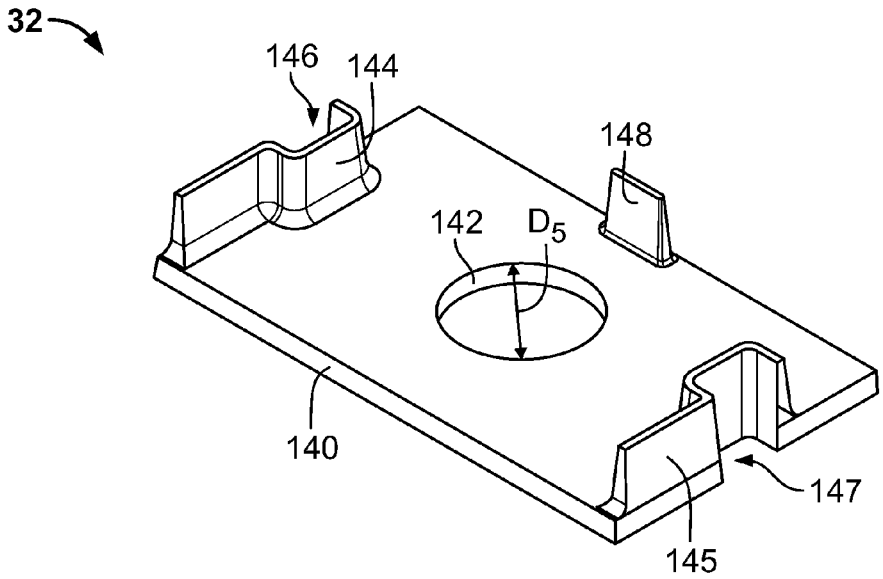
FIG. 9A is a top plan view of the bottom cover plate shown in FIG. 1, in accordance with one embodiment of the present invention.
Figure 9B:
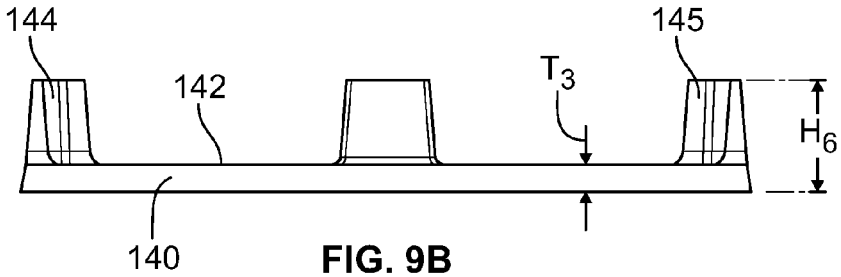
FIG. 9B is a front elevation view of the bottom cover plate shown in FIG. 9A.
Figure 9C:
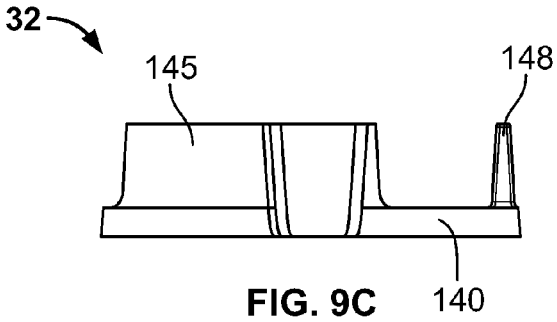
FIG. 9C is a right side view of the bottom cover plate shown in FIG. 9A.

Referring to FIGS. 9A-9C, in one embodiment, the security light preferably includes a bottom cover plate 32 that is adapted to cover a bottom opening of the junction box 28 (FIG. 7B). The bottom cover plate 32 desirably includes a bottom wall 140 having a central opening 142 extending therethrough for providing access to an interior region of the junction box after the bottom cover plate 32 has been assembled with the junction box. The bottom cover plate 32 preferably includes a first support flange 144 extending upwardly from a left side of the bottom wall 140, and a second support flange 145 extending upwardly from a right side of the bottom wall 140. In one embodiment, the first support flange 144 has a first wire channel 146 formed therein, which provides a strain relief for electrical wiring directed into the junction box. The first wire channel 146 also enables the electrical wiring to be brought into the bottom of the junction box for making the junction box more water resistant. The second support flange 145 has a second wire channel 147 that performs the same functions as the first wire channel 146. The bottom cover plate 140 also desirably includes a rear support flange 148 that extends upwardly from a rear edge of the bottom wall 140. In one embodiment, the central opening 142 formed in the bottom wall 140 defines a diameter $D_5$ of about 0.8-0.9 inches, and more preferably about 0.847 inches.

Referring to FIG. 9B, in one embodiment, the bottom wall 140 desirably has a thickness $T_3$ of about 0.125 inches. The support flanges 144, 145, 148 have a height $H_6$ of about 0.500 inches relative to a top surface 142 of the bottom wall 140.

FIG. 9C shows the rear support flange 148 projecting upwardly from a rear edge of the bottom wall 140. The right support flange 145 projects upwardly from a right side of the bottom wall 140. The bottom cover plate 32 is adapted to be assembled with the junction box 28 for covering the bottom opening of the junction box. If it is necessary to obtain access to an internal region of the junction box 28 for wiring, maintenance and/or repair operations, the bottom cover plate 32 is adapted to be selectively removed from its assembly with the junction box.

Figure 10A:
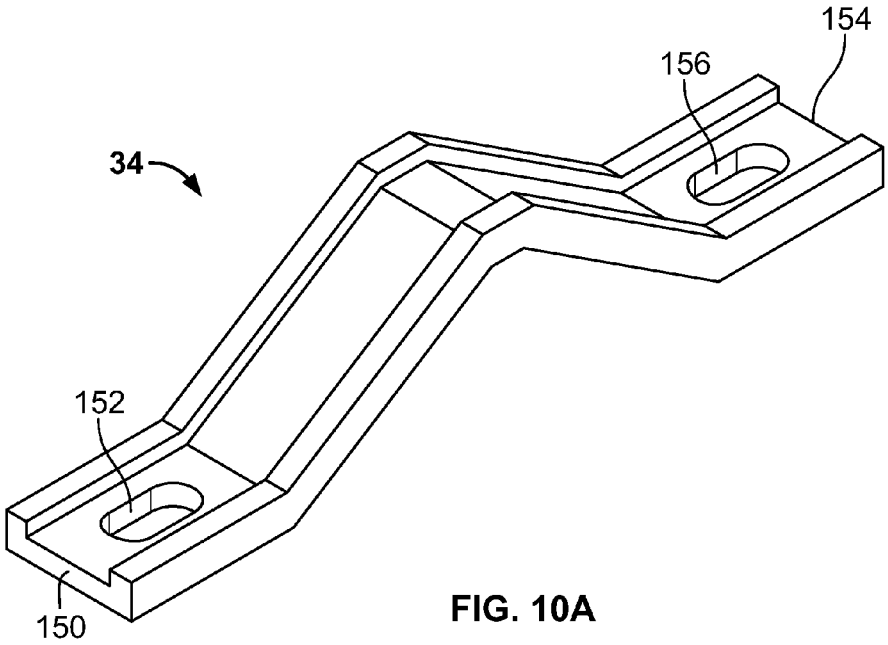
FIG. 10A is a top perspective view of the securing bracket shown in FIG. 1, in accordance with one embodiment of the present invention.

Referring to FIG. 10A, in one embodiment, the security light preferably includes a securing bracket 34 that is assembled with threaded bolts 36A, 36B projecting from a rear of the junction box 28 (FIG. 1). The securing bracket 34 preferably has a first end 150 having a first elongated opening 152 and a second end 154 having a second elongated opening 156. The securing bracket 34 is coupled with the threaded bolts by passing the threaded bolts through the elongated openings 152, 156.

Figure 10B:
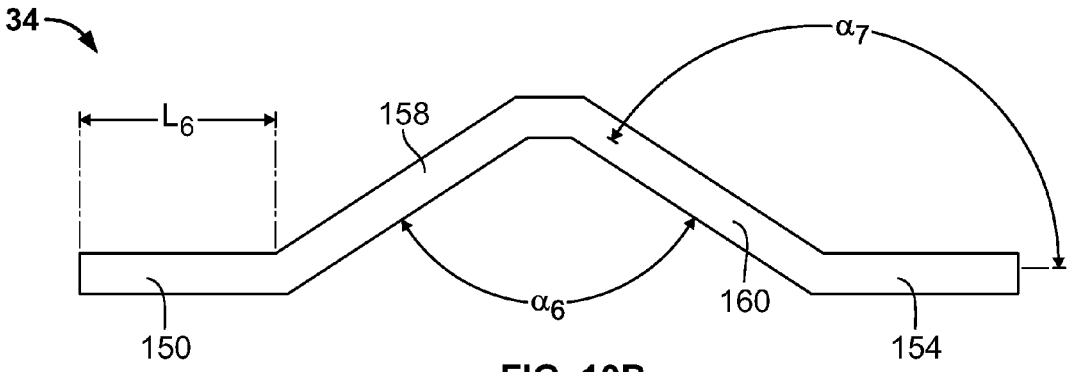
FIG. 10B is a front elevation view of the securing bracket shown in FIG. 10A.

Referring to FIG. 10B, in one embodiment, the securing bracket 34 has a V-shaped central region including a first wing 158 and a second wing 160. The first and second wings define an angle $\alpha_6$ of about 110-120°, and more preferably about 114.3°. The first and second ends 150, 154 of the securing bracket 34 include flat sections that define an angle $\alpha_7$ with the respective wings 158, 160 of about 140-155°, and more preferably about 147.2°. The flat sections 150, 154 preferably have a length $L_6$ of about 0.9-1.0 inches, and more preferably about 0.954 inches.

Figure 11:
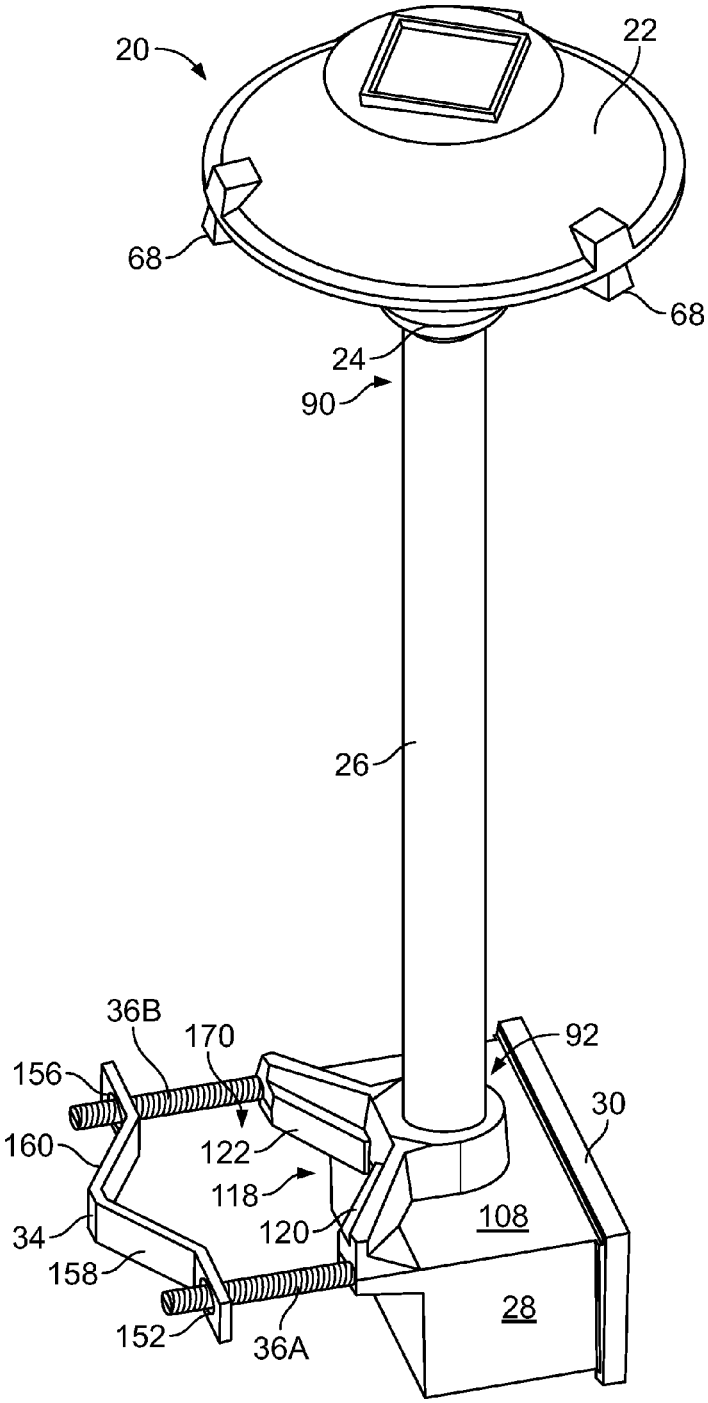
FIG. 11 is a perspective view of a security light for a perimeter fence, in accordance with one embodiment of the present invention.

Referring to FIG. 11, in one embodiment, the securing bracket 34 is assembled with the threaded bolts 36A, 36B projecting from the junction box 28 by passing the threaded bolts 36A, 36B through the elongated openings 152, 156 of the securing bracket 34. The V-shaped opening between the wings 158, 160 of the securing bracket 34 preferably faces the V-shaped opening formed between the wings 120, 122 of the V-shaped flange 118 at the rear end of the junction box 28.

In one embodiment, the security light 20 is adapted to be mounted atop a vertical post of a fence by passing an upper end of the vertical post through a diamond shaped opening 170 defined by the V-shaped flange 118 at the rear of the junction box 28 and the V-shaped securing bracket 34. A clamping force may be generated between the securing bracket 34 and the rear of the junction box 28 by tightening threaded fasteners onto the ends of the threaded bolts 36A, 36B.

In FIG. 11, the hat 22 is secured atop the light module 24 by aligning the openings at the outer ends of the support arms 68 with the threaded openings 44A-44C provided at the underside of the hat 22 (FIG. 2B). Threaded fasteners may be passed through the aligned openings for securing the hat 22 atop the light module 24.

The extension tube 26 has the upper end 90 thereof inserted into the central opening provided at the underside of the central housing of the light module 24, and a lower end 92 of the extension tube 26 is inserted into the central opening provided in the top wall 108 of the junction box 28. The front cover plate 30 is assembled with the junction box 28 for covering the front opening of the junction box.

Figure 12:
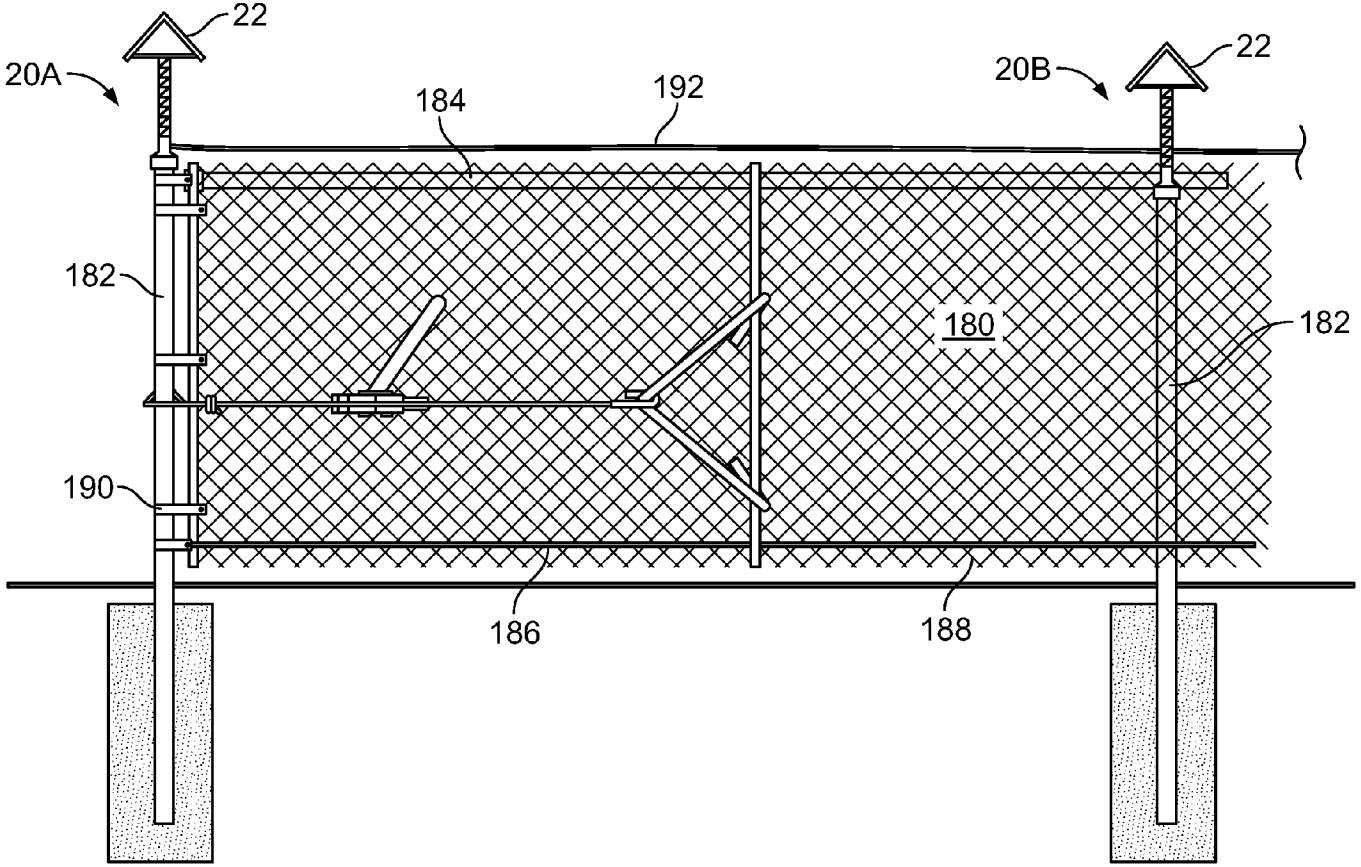
FIG. 12 shows a fence having security lights mounted atop vertical posts of the fence, in accordance with one embodiment of the present invention.

Referring to FIG. 12, in one embodiment, one or more security lights 20A-20B may be assembled atop a fence 180 having vertical support posts 182. In one embodiment, the fence 180 is a chain link fence including the vertical support posts 182, a top support rail 184, a bottom support member 186, and chain link 188 secured to the vertical posts 182 using chain link fasteners 190.

In one embodiment, the diamond shaped opening 170 between the V-shaped flange at the rear end of the junction box 28 and the V-shaped securing bracket 34 (FIG. 11) is preferably passed over the upper end of the vertical post 182. The securing bracket may then be slid along the threaded bolts toward the rear end of the junction box for clamping the vertical post between the securing bracket and the rear end of the junction box. Locking nuts may be passed over the threaded shafts 36A, 36B and tightened for securing the junction box atop or against the vertical post.

Figure 13:
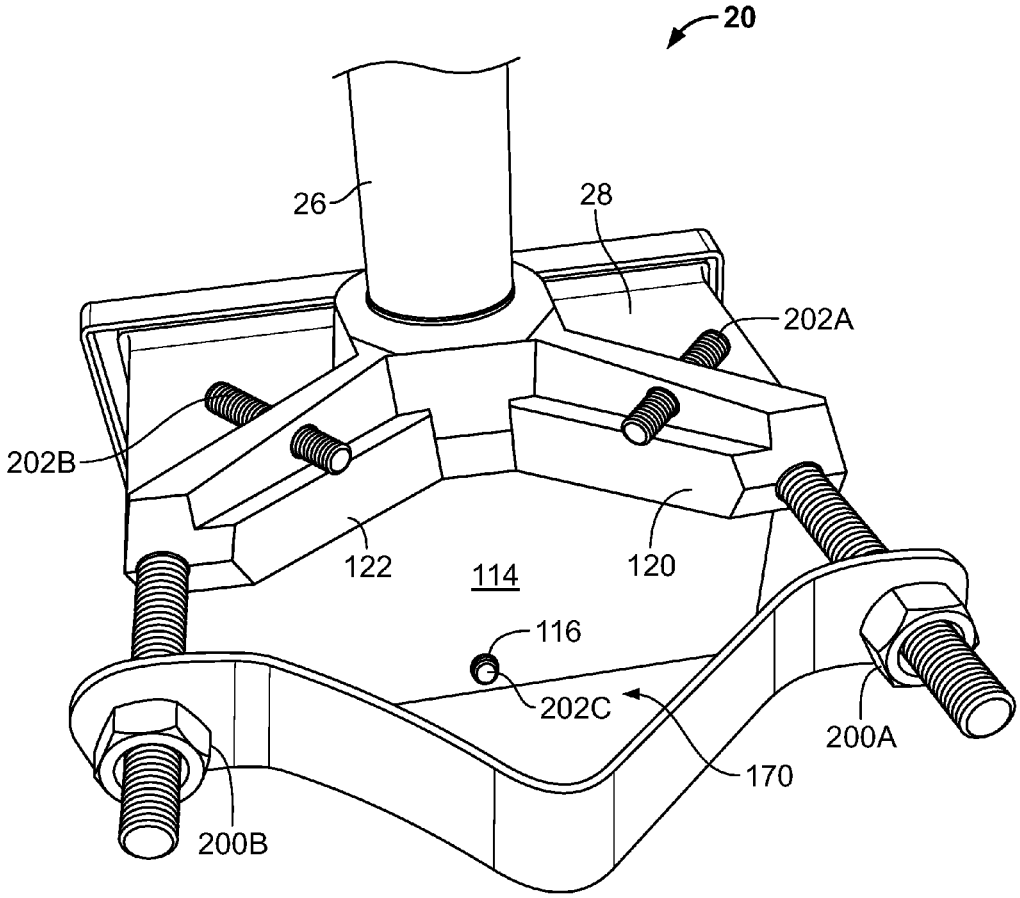
FIG. 13 shows a lower end of a security light including a junction box and a securing bracket for securing the security light to a vertical post of a fence, and an alignment system for aligning the security light atop the vertical post, in accordance with one embodiment of the present invention.

Referring to FIG. 13, in one embodiment, the security light 20 preferably includes an alignment system for properly aligning the security light atop or against a vertical post of a fence. For example, it may be necessary to use the alignment system to insure that the longitudinal axis of the extension tube 26 is parallel with the longitudinal axis of the vertical post to which the security light 20 is attached. In one embodiment, after a vertical post has been inserted into the diamond-shaped opening 170 between the securing bracket 34 and the wings 120, 122 of the V-shaped flange 118 at the rear end of the junction box 28, locking nuts 200A, 200B may then be tightened for clamping the junction box 28 onto the vertical post.

In one embodiment, the alignment system preferably includes a set of alignment elements 202A, 202B, 202C that extend into the diamond-shaped opening 170. In one embodiment, a first alignment element 202A is a threaded shaft that extends through a first threaded opening in the first wing 120, and a second alignment element 202B is a threaded shaft that extends through a second threaded opening in the second wing 122. The alignment system preferable includes a third alignment element 202C that extends through the threaded opening 116 in the rear wall 114 of the junction box 28. The three alignment elements 202A-202C may function as a tripod-like alignment mechanism for insuring that the longitudinal axis of the extension tube 26 is aligned with the longitudinal axis of the vertical post on the fence. Once the extension tube 26 has been properly aligned using the alignment system, the locking nuts 200A and 200B may be further tightened for securing the security light to the vertical post. In one embodiment, a properly aligned security light has an extension tube that extends along an axis that is parallel to a vertical post and perpendicular to the ground, with the support arms 68 of the light module 24 extending parallel to the ground (FIG. 5A). The alignment process may be repeated for the other security lights in the security lighting system to insure that all of the security lights are properly aligned atop the respective vertical posts of the fence.

Referring to FIG. 12, the security lights 20A-20B are preferably connected to an electrical circuit using electrically conductive wire 192 that interconnects the security lights 20A-20B to a circuit. In operation, the LED modules of the security lights 20A-20B generate light that is reflected downwardly and outwardly by the reflective coating on the underside of the hats 22. As a result, the light is reflected downward toward the fence 180 and the ground 194. In FIG. 12, a security light 20 is mounted atop each of the vertical posts 182 of the fence 180. In other embodiments, however, the spacing between the security lights 20A-20B may be increased. For example, in one embodiment, a security light may be mounted atop every second vertically extending support post 182. In another embodiment, a security light may be mounted atop every third vertically extending support post 182. The spacing between the security lights 20A-20B depends on local factors including the geographic area, local weather conditions and the level of the security risk.

Figure 14:
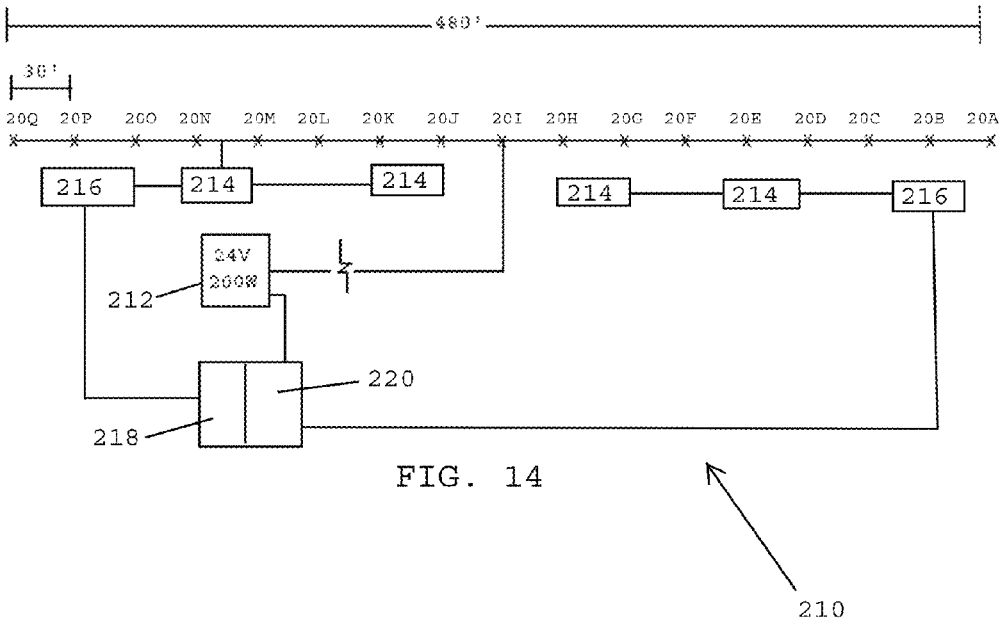
FIG. 14 shows a schematic diagram of a security lighting system for a perimeter fence, in accordance with one embodiment of the present invention.

Referring to FIG. 14, in one embodiment, a security lighting system 210 for a fence preferably includes a plurality of individual security lights 20A-20Q. In one embodiment, a plurality of security lights 20A-20Q are secured on respective fence posts that are spaced 30' from one another for providing security lighting for a fence have a total length of 480'. In other embodiments, a security light may be placed on every other post, every third post, etc., depending upon the environment and the security needs. The security lights 20A-20Q are electrically interconnected using electrical wiring and are coupled with a low voltage transformer 212 that provides sufficient power to illuminate the LED units. The low voltage transformer may have a direct current or an alternating current output.

In one embodiment, the security lighting system 210 may have one or more motion sensors 214 that are adapted to activate all of the security lights 20A-20Q of the lighting system. In one embodiment, the motion sensors may activate only one or a smaller group of security lights that cover a particular area of the fence, as designated by an installer. In one embodiment, a security lighting system for a fence may include one or more remote cameras 216 for monitoring the fence. The lighting system may include a video recording system 218 for storing video recorded by the remote cameras. In one embodiment, the security lighting system may include a microprocessor 220 for controlling operation of the security lights 20A-20Q, the motion sensors 214, the remote cameras 216, and the video recording system 218 of the security lighting system 210.

The present invention provides a dramatic advantage over conventional security light systems that propagate direct light. In conventional systems, security personnel monitor the perimeter of the security fence by using cameras pointed at the perimeter of the fence. Unfortunately, the lights mounted atop the fence generate direct light that shines directly into the camera lens, which may "blind" the camera due to a light hot spot. The present invention overcomes this deficiency because all of the light is reflected light that does not produce hot spots. In addition, the present invention utilizes LED light as opposed to conventional lights requiring much higher voltage. As a result, the security light system disclosed herein utilizes significantly less power which saves money. In addition, due to the security light system herein using lower power, there is no need to obtain costly permits or require the services of a professional electrician to install the system. The system made be installed by non-trained personnel that have no particular electrical training.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A security lighting system for a fence comprising:

a plurality of security lights, each said security light including a light module having a LED unit adapted to generate light and a hat overlying said LED unit that is adapted to block the escape of direct light from said light module while allowing reflected light to escape from said light module;

a circuit including electrical wiring for interconnecting said plurality of security lights;

a transformer connected with said electrical wiring for providing power to said system;

each said security light comprising a junction box having an interior compartment adapted to contain electrical components for operating said security light, said junction box including a top wall, a rear end including a rear wall that closes said rear end of said junction box, and a front end having a front opening that opposes said rear wall, an extension tube having an upper end secured to said light module and a lower end secured to said top wall of said junction box, said junction box having said rear end being abutted against and secured to an outer surface of a fence post, and a clamp assembly including a securing bracket that is coupled with said junction box and that opposes said rear end of said junction box, said rear end of said junction box and said securing bracket coupled therewith defining an opening that is adapted to receive said fence post, wherein with said fence post disposed in said opening, said securing bracket is moveable toward said rear end of said junction box for clamping said fence post between said securing bracket and said rear end of said junction box so that said extension tube extends above an upper end of said fence post with said light module being located above the upper end of said fence post, wherein the reflected light that escapes from said light module is directed downward toward the upper end of said fence post;

said front opening of said junction box providing access to said interior compartment of said junction box for conducting electrical wiring operations, said front opening of said junction box facing away from said rear end of said junction box and said fence post when said fence post is clamped between said securing bracket and said rear end of said junction box;

a front cover plate assembled with said junction box for covering said front opening of said junction box, wherein said front cover plate is removable for providing access to said interior compartment of said junction box when said fence post is clamped between said securing bracket and said rear end of said junction box.

2. The system as claimed in claim 1, wherein each said light module comprises:

a central housing having an upper end with a top surface;

support arms extending outwardly from said central housing;

a depression formed in the top surface of said central housing; and said LED unit disposed in said depression.

3. The system as claimed in claim 2, wherein said support arms extend outwardly from said central housing, each said support arm having a top surface that lies in a plane that is parallel to the top surface of said central housing.

4. The system as claimed in claim 3, wherein said hat is secured to said support arms, and wherein each said support arm has a triangular shaped cross-section for minimizing the surface area of said support arm facing an underside of said hat.

5. The system as claimed in claim 4, wherein said hat has a bottom surface having a concave shape that overlies said LED unit.

6. The system as claimed in claim 5, wherein said concave shaped bottom surface has a centrally located dimple that is aligned over said LED unit, said centrally located dimple dividing said concave shaped bottom surface into a first concave region and a second concave region.

7. The system as claimed in claim 6, wherein said support arms are evenly spaced from one another.

8. The system as claimed in claim 7, wherein said hat has an outer perimeter in contact with said support arms.

9. The system as claimed in claim 8, wherein the outer perimeter of said hat lies in a plane that is parallel to the surface of said central housing.

10. The system as claimed in claim 8, further comprising one or more fasteners for securing said hat to said support arms.

11. The system as claimed in claim 10, wherein outer ends of said support arms have openings, and wherein said hat has threaded openings accessible at the outer perimeter thereof that are aligned with said support arm openings.

12. The system as claimed in claim 11, further comprising threaded fasteners passing through said support arm openings and threaded into said threaded openings of said hat for securing said hat to said support arms.

13. The system as claimed in claim 6, wherein said concave bottom surface of said hat has a reflective coating for reflecting light generated by said LED unit.

14. The system as claimed in claim 6, wherein said support arms and said central housing have reflective coatings for reflecting light.

15. The system as claimed in claim 2, further comprising:

said clamp assembly including a pair of threaded bolts projecting from said rear end of said junction box that pass through corresponding openings on said securing bracket and threaded fasteners that are tightened onto said threaded bolts for generating clamping force between said securing bracket and said rear end of said junction box;

an alignment system coupled with said junction box for aligning said extension tube with the longitudinal axis of said fence post and aligning said support arms of said light module with a plane that is perpendicular to the longitudinal axis of said fence post, wherein said alignment system comprises at least one threaded shaft that extends through at least one threaded opening formed in said junction box.

16. The system as claimed in claim 1, wherein said transformer produces a direct current output of 12-24 VDC.

17. The system as claimed in claim 1, wherein said transformer produces an alternating current output of 12-24 VAC.

18. A security lighting system for a fence having a plurality of security lights mountable to upper ends of fence posts, each said security light comprising:

a light module including a central housing having a top surface, support arms extending outwardly from said central housing, a depression formed in the top surface of said central housing, and a LED unit mounted in the depression for generating light that projects away from and over the top surface of said central housing;

a hat covering the top surface and an outer perimeter of said central housing for blocking the escape of direct light from the top and sides of said light module while allowing reflected light to escape from a bottom of said light module;

said hat having a concave shaped bottom surface with a reflective coating that opposes said LED unit for reflecting light generated by said LED unit toward the bottom of said light module;

a junction box having an interior compartment adapted to contain electrical components for operating said security light, said junction box including a top wall with a central opening, a rear end including a rear wall that closes said rear end of said junction box, and a front end having a front opening that opposes said rear wall;

an extension tube having an upper end secured to said central housing of said light module and a lower end secured to said central opening of said top wall of said junction box;

said extension tube having a central conduit for passing electrical wiring from said junction box to said light module;

a clamp assembly including a securing bracket that is coupled with said junction box and that opposes a rear end of said junction box for securing said junction box to a fence post, wherein said rear end of said secured junction box is abutted against an outer surface of said fence post, said rear end of said junction box and said securing bracket coupled therewith defining an opening that is adapted to receive said fence post, wherein with said fence post disposed in said opening, said securing bracket is moveable toward said rear end of said junction box for clamping said fence post between said securing bracket and said junction box with said extension tube extending above an upper end of said fence post and said light module being located above the upper end of said fence post;

an alignment system separate from said clamp assembly and coupled with said junction box for aligning said extension tube with the longitudinal axis of said fence post and aligning said support arms with a plane that is perpendicular to the longitudinal axis of said fence post;

said front opening of said junction box providing access to said interior compartment of said junction box for conducting electrical wiring operations, wherein said front opening of said junction box faces away from said rear end of said junction box and said fence post when said fence post is clamped between said securing bracket and said rear end of said junction box;

a front cover plate assembled with said junction box for covering said front opening of said junction box, wherein said front cover plate is removable for providing access to said interior compartment of said junction box when said fence post is clamped between said securing bracket and said rear end of said junction box.

19. The system as claimed is claim 18, further comprising:

electrical wiring interconnecting said plurality of security lights;

a transformer connected with said electrical wiring for providing power to said plurality of security lights, wherein said transformer produces a direct current output of 12-24 VDC.

20. The system as claimed in claim 18, wherein said hats mounted atop said light modules are opaque and have convex top surfaces and concave shaped bottom surfaces.

21. The system as claimed in claim 1, further comprising:

said junction box including a ridge that extends along an upper edge and two side edges of said front opening for directing moisture away from said front opening of said junction box, wherein said front cover plate has a pocket adapted to receive said ridge of said junction box;

a bottom cover plate assembled with said junction box for covering a bottom opening of said junction box that opposes said top wall of said junction box, wherein said bottom cover plate is removable from assembly with said junction box for obtaining access to said interior compartment of said junction box, said bottom cover plate including a bottom wall having a first support flange extending upwardly from a first side of said bottom wall and a second support flange extending upwardly from a second side of said bottom wall, said first support flange having a first wire channel formed therein that provides a first strain relief for said electrical wiring directed into said junction box, said second support flange having a second wire channel formed therein that provides a second strain relief for said electrical wiring directed into said junction box.

22. The system as claimed in claim 18, further comprising:

said junction box including a ridge that extends along an upper edge and two side edges of said front opening, wherein said ridge is adapted to direct moisture away from said front opening of said junction box, wherein said front cover plate has a pocket adapted to receive said ridge of said junction box;

a bottom cover plate assembled with said junction box for covering a bottom opening of said junction box, wherein said bottom cover plate is removable from assembly with said junction box for obtaining access to said interior compartment of said junction box, said bottom cover plate including a bottom wall having a first support flange extending upwardly from a first side of said bottom wall and a second support flange extending upwardly from a second side of said bottom wall, said first support flange having a first wire channel formed therein that provides a first strain relief for said electrical wiring directed into said junction box, said second support flange having a second wire channel formed therein that provides a second strain relief for said electrical wiring directed into said junction box.

23. A security lighting system for a fence comprising:

a plurality of security lights, each said security light including a light module having a LED unit adapted to generate light and a hat overlying said LED unit;

a circuit including electrical wiring for interconnecting said plurality of security lights;

a transformer connected with said electrical wiring for providing power to said system;

each said security light comprising a junction box having an interior compartment adapted to contain electrical components for operating said security light, said junction box including a top wall with a central opening, an extension tube having an upper end secured to said light module and a lower end secured to said central opening of said junction box, said junction box having a rear end including a rear wall that closes said rear end of said junction box, said rear end of said junction box being abutted against and secured to an outer surface of a fence post, and a clamp assembly including a securing bracket that is coupled with said junction box and that opposes said rear end of said junction box, said rear end of said junction box and said securing bracket coupled therewith defining an opening that is adapted to receive said fence post, wherein with said fence post disposed in said opening, said securing bracket is moveable toward said rear end of said junction box for clamping said fence post between said securing bracket and said rear end of said junction box;

said junction box including a front end having a front opening that provides access to said electrical components contained within said junction box, said front opening of said junction box facing away from said rear end of said junction box and said fence post when said fence post is clamped between said securing bracket and said rear end of said junction box;

a front cover plate assembled with said junction box for covering said front opening of said junction box, wherein said front cover plate is removable from said junction box for uncovering said front opening and providing access to said interior compartment of said junction box;

a bottom cover plate assembled with said junction box for covering a bottom opening of said junction box, wherein said bottom cover plate is removable from assembly with said junction box for providing access to said interior compartment of said junction box, said bottom cover plate including a bottom wall having a first support flange extending upwardly from a first side of said bottom wall and a second support flange extending upwardly from a second side of said bottom wall, said first support flange having a first wire channel formed therein that provides a first strain relief for said electrical wiring directed into said junction box, said second support flange having a second wire channel formed therein that provides a second strain relief for said electrical wiring directed into said junction box.

* * * * *